United States Patent [19]

Andoh

[11] 4,323,296

[45] Apr. 6, 1982

[54] CONNECTOR

[75] Inventor: Ikuhiro Andoh, Kawasaki, Japan

[73] Assignee: Fujitsu Limited, Kawasaki, Japan

[21] Appl. No.: 118,216

[22] Filed: Feb. 4, 1980

[30] Foreign Application Priority Data

Feb. 7, 1979 [JP] Japan ..... 54-14714[U]

[51] Int. Cl.[3] ..... H01R 13/506; H01R 13/516

[52] U.S. Cl. ..... 339/217 S; 339/210 M; 339/218 M

[58] Field of Search ..... 339/91 R, 103 M, 107, 339/217 R, 217 S, 218 R, 218 M, 206–208, 210

[56] References Cited

U.S. PATENT DOCUMENTS 3,399,374 8/1968 Pauza et al. ..... 339/91 R
3,944,312 3/1976 Koenig ..... 339/217 R X
4,108,527 8/1978 Douty et al. ..... 339/107
4,127,314 11/1978 Hasimoto ..... 339/217 S X

*Primary Examiner*—Eugene F. Desmond
*Attorney, Agent, or Firm*—Staas & Halsey

[57] ABSTRACT

A connector comprising a molded connector housing, including insertion holes which can be formed by using a molding core and which receive female connector elements which are to be inserted therein, and including molded flexible abutment members which are provided with separate free ends which provide large contact areas between the flexible abutment members and the corresponding female contact, so as to prevent the female contact elements from coming out of the corresponding insertion holes. The flexible abutment members are provided with recessed grooves having inclined surfaces which enable the molding core to be withdrawn from the connector housing after forming the insertion holes.

10 Claims, 9 Drawing Figures

CONNECTOR

BACKGROUND OF THE INVENTION

This invention relates to a connector for establishing an electrical connection between male contacts and female contacts, and in particular to a connector having a molded connector housing which receives contact terminals which serve as female contacts.

In the connector as mentioned above, the contact terminals are inserted into and held in place in corresponding insertion holes which are formed in the connector housing. It is therefore necessary to provide means for retaining the contact terminals in the corresponding insertion holes so as to prevent the contact terminals from coming out from the insertion holes.

There is known a connector having a connector housing which is provided with stepped portions located in the insertion holes, so that elastic projections (lances) formed on the contact terminals are engaged by the stepped portions so as to prevent the contact terminals from coming out of the corresponding insertion holes. However, in this type of a connector, there is a strong possibility that the lances may be broken or deformed during the operation of the connector, resulting in the separation of the contact terminals from the corresponding insertion holes while the connector is in use.

In order to solve the problem of the lances being broken or deformed during the operation of the connector, there has been proposed a connector housing which is itself provided with abutment members, in place of the lances provided on the contact terminals, so that the abutment members engage corresponding recesses which are formed in the contact terminals. However, in the connector hitherto known, since contact areas between the abutment projections of the connector housing and the corresponding contact terminals are small, the abutment projections can be easily broken when the corresponding contact terminals are subjected to a large drawing force. In particular, when the connector is a multi-contact connector type, breakage of only one abutment member requires replacement of the connector by a new one.

SUMMARY OF THE INVENTION

The present invention is directed to a type of a connector in which the connector housing is provided with abutment members and the contact terminals are provided with recesses which the abutment members engage.

The object of the present invention is to provide a reliable connector which can hold the contact terminals at a predetermined position in the corresponding insertion holes so that the terminals cannot accidentally come out of the insertion holes, and whereby an electrical connection between the male and female contacts can be reliably ensured.

In order to eliminate the above mentioned drawback, in the present invention large contact areas are provided between the abutment members and the corresponding contact terminals.

According to the present invention, there is provided a connector comprising a molded connector housing including insertion holes which can be formed by using a molding core and which receive female connector elements which are to be inserted therein; and flexible abutment members which are located in the corresponding insertion holes and which are molded integral with the connector housing. The flexible abutment members are provided with separate free ends which provide large contact areas between the flexible abutment members and the corresponding female contact elements which are to be inserted in the insertion holes to prevent the female contact elements from coming out of the corresponding insertion holes. The flexible abutment members are also provided with recessed grooves having inclined surfaces which enable the molding core to be withdrawn from the connector housing to form the insertion holes after the completion of the connector housing.

BRIEF DESCRIPTION OF THE DRAWING

The invention will be discussed below in detail, with reference to the accompanying drawings, in which.

DESCRIPTION OF THE PREFERRED EMBODIMENTS

Figure 1:
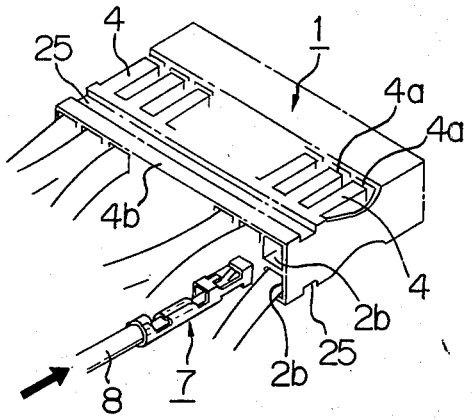
FIG. 1 is a perspective view of a connector housing of a connector, according to the present invention, viewed from behind.
Figure 2:
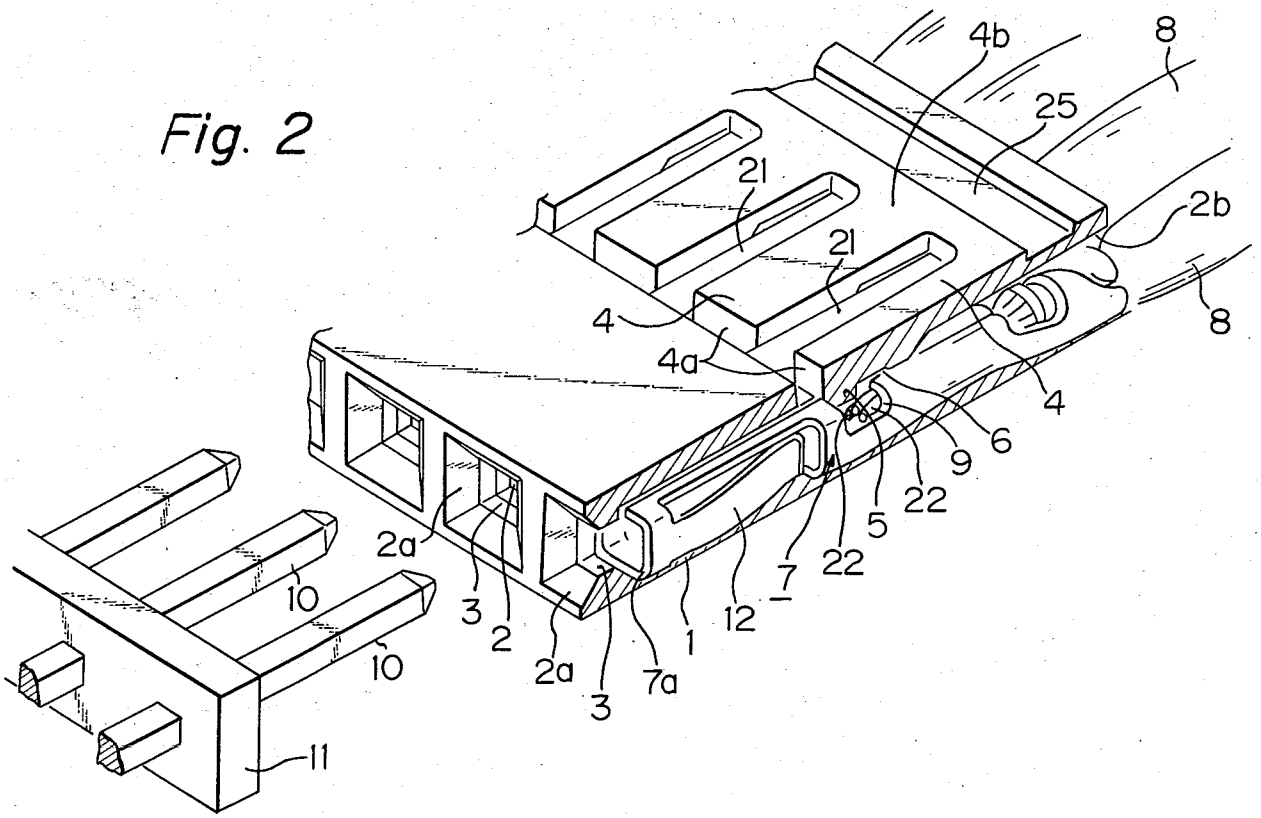
FIG. 2 is a partially broken and enlarged perspective view of the connector housing illustrated in FIG. 1, but viewed from the front.

First, with reference to FIGS. 1 and 2, the connector housing is designated as 1. The connector housing 1 has two series of insertion holes 2 (only one series of insertion holes 2 are illustrated in FIG. 2) in the illustrated embodiment. The number of the series of the insertion holes 2 is not limited to two and may be less or more than two. Each insertion hole 2 has open ends **2*a* and 2*b*. Through one of the open ends, for example 2*b*, is inserted into the insertion hole 2 a contact terminal 7 which forms a female contact. Through the other open end 2*a* of each insertion hole are inserted corresponding contact pins 10, which form male contacts and which are arranged in correspondence to the arrangement of the insertion holes 2. Each open end 2*a* is provided with a smaller diameter portion 3**.

The connector housing 1 has two series of flexible abutment members 4 which are molded integrally with the connector housing 1. The abutment members 4 have a common base end **4*b* and separate free ends 4*a* so that the members 4 can be flexible. The members 4 are arranged corresponding to the insertion holes 2 so that the members 4 form the top walls of the insertion holes 2. The members 4 are separated by partition walls 21 which form the side walls of the insertion holes 2. Each of the members 4 has at its free end 4*a* an abutment 5 which projects into the corresponding insertion hole 2, and a recessed groove 6**.

The contact terminals 7 can be made, for example, by punching and bending metal plates of a conductive material, such as a phosphor bronze. At one end of the terminals 7 are crimped leads 8, having a single wire or a plurality of wires 22. Each of the terminals 7 is provided, at its other end, with a pair of opposed spring contacts 12, only one of which is illustrated in FIG. 2. The pairs of spring contacts 12 can elastically hold therebetween the corresponding contact pins 10 when inserted thus making an electrical connection between the leads 8 and the corresponding contact pins 10. Each of the terminals 7 further comprises an engagement recess 9 into which the abutment 5 of the member 4 can be fitted. Thus, when the abutments 5 of the members 4 are fitted into the corresponding recesses 9 of the terminals 7, the terminals 7 cannot come out of the corresponding insertion holes 2, even under the influence of a large drawing force being applied to the leads 8.

Figure 6:
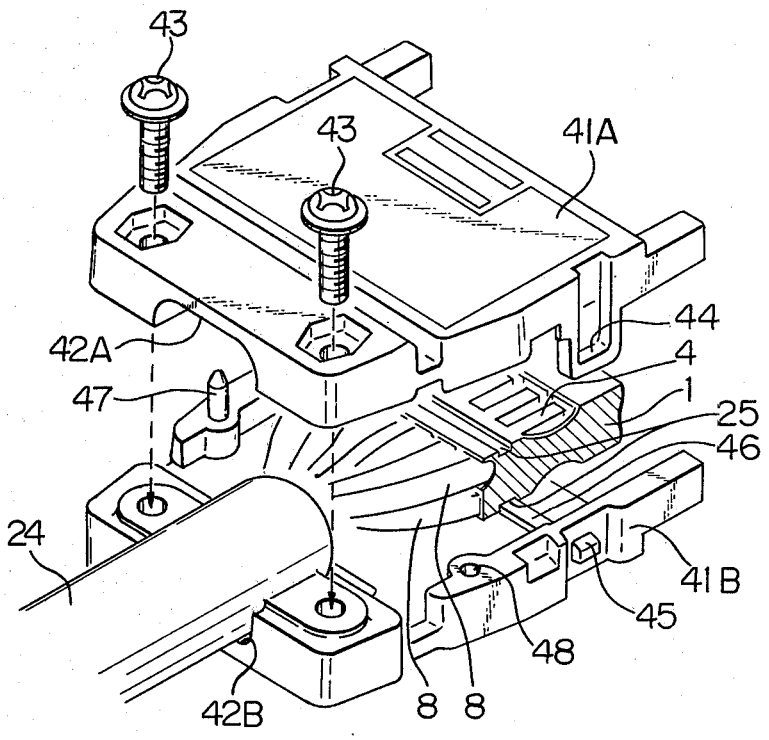
FIG. 6 is an exploded perspective view of a connector with upper and lower covers, according to the present invention.

The leads 8 are stripped at their front ends to expose bare wires 22 which are in turn crimped to the terminals 7 to establish an electrical connection between the terminals 7 and the leads 8. The leads 8 are preferably collected to form a cable 24 (FIG. 6).

The contact pins 10 can be formed, for example, by crushing conductive metal rods. They are secured to a molded body 11 (FIG. 2) to provide male connector elements. The female connector elements are provided by the contact terminals 7. When the contact pins 10 of the male connector elements are inserted into the corresponding contact terminals 7 of the female connector elements and are contacted by the spring contacts 12, an electrical connection is established between the female connector elements and male connector elements.

Figure 4:
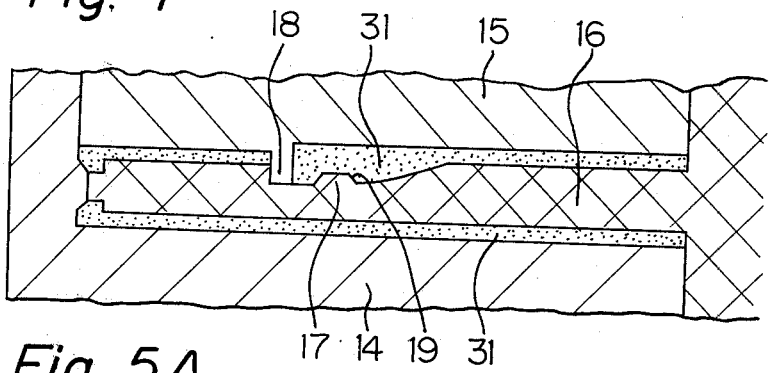
FIG. 4 is a sectional side view of a molding device for molding a connector housing of a connector according to the present invention.

As mentioned above, in the open ends 2*a* of the insertion holes 2 are provided the smaller diameter portions 3 which are adapted to prevent the front ends of the contact pins 10 from coming into contact with end faces 7*a* of the contact terminals 7 when the contact pins 10 are inserted into the contact terminals 7. Therefore, a mold core 16 (FIG. 4) for molding insertion holes 2 must be withdrawn therefrom only in one direction, i.e. in the right hand direction as illustrated in FIG. 4, because of the presence of the smaller diameter portions 3. However, the abutments 5 which project into the insertion holes 2 hinder the core 16 from being withdrawn from the insertion holes 2 in this fashion.

Figure 3:
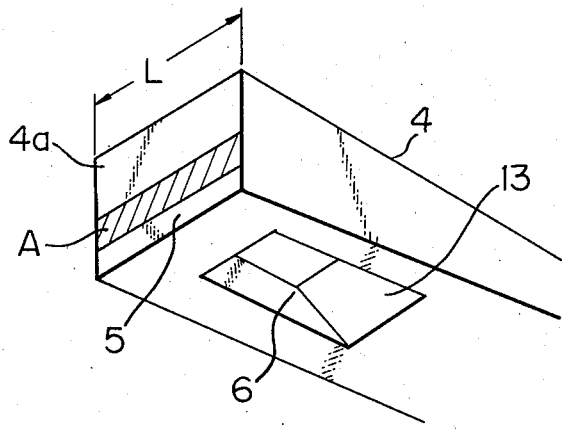
FIG. 3 is an enlarged perspective view of a flexible abutment arm of the connector housing illustrated in FIG. 2.

In order to make it possible to withdraw the core 16 from the insertion holes 2 which are to be formed by the core 16, the present invention provides the recessed grooves 6, which are formed on the bottom sides of the members 4, adjacent to the abutments 5, as illustrated in FIG. 3. Each of the recessed grooves 6 has an inclined surface 13.

With reference to FIG. 4, the connector housing can be manufactured by filling cavities with a molding material 31 such as an insulation resin (sand-like), said cavities being defined by an upper die 15, a lower die 14 and the core 16. The core 16 has projections 17 which are adapted to form the recessed grooves 6 (FIG. 3) on the bottoms of the flexible members 4 (FIG. 3) which are to be molded. The projections 17 have inclined surfaces 19 corresponding to the inclined surfaces 13 (FIG. 3) of the recessed grooves 6. The upper die 15 has projections 18 which are adapted to form the abutments 5 (FIG. 3) of the flexible members 4 (FIG. 3).

Figure 5A:
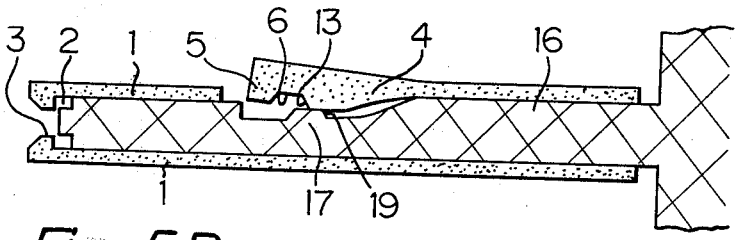
FIGS. 5A–5C are sectional side views which illustrate successive steps in a molding process for manufacturing a molded connector housing of a connector according to the present invention.
Figure 5B:
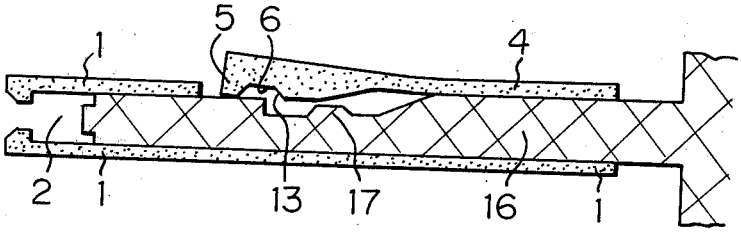
Figure 5C:
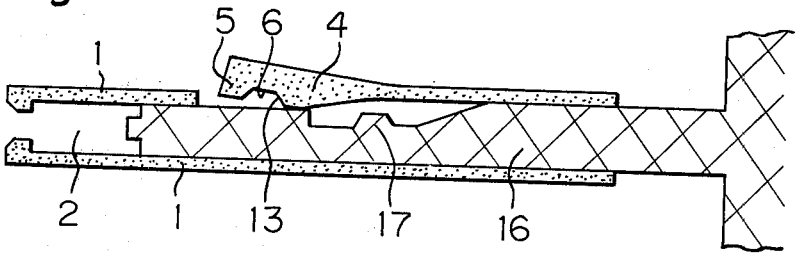

FIGS. 5A–5C illustrate successive steps in withdrawing the core 16, after the upper and lower dies 15 and 14 (FIG. 4) have been removed. When the core 16 is withdrawn from the insertion holes 2, the molded flexible members 4 are flexed upward due to the presence of the inclined surfaces 19 of the core 16. It will be understood that the molded flexible members 4 return to their original positions, due to their flexibility, after the core 16 is withdrawn from the insertion holes 2. Thus, the connector housing 1 having flexible members 4 integral therewith are molded.

Figure 7:
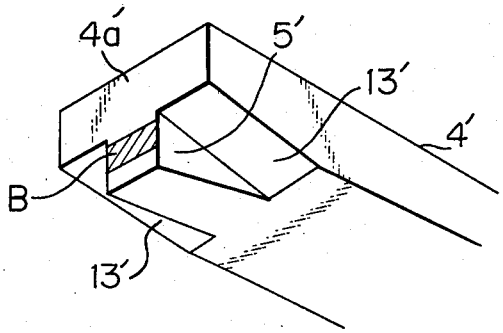
Fig. 7 PRIOR ART
FIG. 7 is a perspective view of a known flexible abutment member according to the prior art.

According to the present invention, the area A of the free end 4*a* of each of the flexible members 4, which is hatched by oblique lines in FIG. 3, contributes to contact with the corresponding contact terminals 7 (FIG. 2) to prevent the latter from coming out of the corresponding insertion hole 2 (FIG. 2). That is, the area A extends over the entire width L of the free end 4*a*, and accordingly is considerably larger than the area B hatched by oblique lines in FIG. 7 which illustrates a flexible member 4' according to the prior art. In FIG. 7, the prior art flexible member 4' has two inclined surfaces 13' on both sides of an abutment 5'. That is, the inclined surfaces 13' extend to the front face of the free end 4*a*' on both sides of the abutment 5'. This results in a decreased contact area, which is identical to area B, in comparison with area A of the present invention as illustrated in FIG. 3. The flexible member 4' according to the prior art as illustrated in FIG. 7 has the drawback that the abutment 5' can be easily broken or torn because of the small contact area B when a large pressing force is applied to the free end 4*a*' of the flexible arm 4' by a contact lead (not illustrated) such as the contact terminal 7 of the present invention. By contrast, in the present invention, since large contact areas A (FIG. 3) can be provided between the contact terminals 7 and the corresponding abutments 5 of the flexible members 4, there is no possibility that the abutments 5 might be broken or torn by the contact terminals 7, even when a strong force is applied to the latter. The provision of the recessed grooves 6 having the inclined surfaces 13 makes it possible to provide the abutments 5 having the large contact area A.

The connector housing 1 is preferably protected by a pair of upper and lower insulation covers 41A and 41B, as illustrated in FIG. 6.

The insulation covers 41A and 41B have grooves 42A and 42B which receive the cable 24. The covers 41A and 41B hold the connector housing 1 therebetween and are for example, by machine screws 43 and nuts (not illustrated). Each of the covers 41A and 41B has a U-shaped member 44 and a projection 45. The covers 41A and 41B are assembled in a snap fashion by the engagement of the U-shaped members 44 and the projections 45. In order to prevent the connector housing 1 from being displaced between the upper and lower covers 41A and 41B, the connector housing 1 is provided, on its upper and lower faces, with channels 25 which may be U-shaped in section. Since the covers 41A and 41B are provided, on their inner faces, with ridges 46 (only one of which is illustrated in FIG. 6) which are closely fitted in the corresponding channels 25 of the connector when held between the covers, the flexible arms which might otherwise buckle when they are subject to compression forces in the lengthwise direction by the corresponding contact terminals do not buckle even under the influence of withdrawing forces.

What is claimed is:

1. A connector comprising:

a molded connector housing including insertion holes which can be formed by using a molding core and which receive female connector elements which may be inserted therein; and flexible abutment members which are located in the corresponding insertion holes and which are molded integrally with the connector housing, said flexible abutment members being provided with separate free ends which provide large contact areas between the flexible abutment members and the corresponding female contact elements which are to inserted in the insertion holes, said free ends being oriented so as to tend to prevent the female contact elements from coming out of the corresponding insertion holes, each of said flexible abutment members also being provided with a recessed groove having an inclined surface at one end thereof which enables all of the members to be flexed while permitting the molding core to be withdrawn from the connector housing to form the insertion holes after the completion of the connector housing molding operation.

2. A connector according to claim 1, wherein said flexible abutment members are in the form of flexible arms which include a common base end integral with the connector housing and separate free ends with end faces, said flexible abutment members being provided with abutments which project into the corresponding insertion holes and which have end faces which are brought into contact with the female contact elements which may be inserted in the insertion holes, over the entire widths of the end faces.

3. The connector of claim 1, further comprising first and second insulation covers which immovably hold the connector housing therebetween.

4. The connector of claim 3, wherein the flexible abutment members bear against the inner faces of the insulation covers.

5. The connector of claims 3 or 4, wherein said connector housing is provided on its upper and lower faces with channels traversely of the housing, and wherein said first and second covers are provided on their inner faces with ridges traversely thereof which are closely fitted in the corresponding channels.

6. A connector housing which can be formed using a molding core, for permanent insertion of appropriate female connecting elements therein so as to compose a female connector, said connector housing being formed so as to include:

a plurality of insertion holes molded integral with the connector housing, for receiving female connecting elements inserted therein;

a plurality of flexible abutment members, each having one free end and one end molded integral with the connector housing, each said free end being disposed within one of said insertion holes in such position as to oppose withdrawal of the appropriate female connecting element when inserted; and means for flexing each said flexible abutment member while the molding core is withdrawn from said insertion holes, whereby withdrawal of the molding core is not obstructed;

said flexing means being formed within each of said flexible abutment members, but not at said free end thereof.

7. The molded connector housing of claim 6, wherein each said free end comprises the full cross-section of each said flexible abutment member, respectively.

8. The molded connector housing of claim 7, wherein said flexing means comprises a recessed grooved and inclined surface formed on each said flexible abutment member, but not at said free end thereof.

9. The molded connector housing of claim 7 or 8, further comprising first and second insulation covers connected together while on either side of said connector housing, whereby said connector housing is held immovable between said insulation covers.

10. The device of claim 9, wherein:

two surfaces of said connector housing include channels which are traverse to the housing; and said insulation covers include ridges on their inner surfaces traversely thereof which fit closely into the corresponding channels of the connector housing.

* * * * *

UNITED STATES PATENT AND TRADEMARK OFFICE

CERTIFICATE OF CORRECTION

PATENT NO. : 4,323,296

DATED : April 6, 1982

INVENTOR(S) : Ikuhiro Andoh

It is certified that error appears in the above—identified patent and that said Letters Patent is hereby corrected as shown below:

Front page, [57] ABSTRACT, line 8, "contact," s/b --contact elements,--.

Column 3, line 10, "inserted" s/b --inserted,--.

Column 4, line 29, "arm" s/b --member--;
line 47, "are" s/b --are interconnected,--;
line 60, "connector" s/b --connector housing--.

Column 5, line 10, "to" s/b --to be--.

Signed and Sealed this

*Seventeenth* Day of *August 1982*

[SEAL]

*Attest:*

GERALD J. MOSSINGHOFF

*Attesting Officer*

*Commissioner of Patents and Trademarks*